United States Patent [19]

Salvati

[11] 4,313,098

[45] Jan. 26, 1982

[54] CIRCUIT INTERRUPTER TRIP UNIT

[75] Inventor: John G. Salvati, Patterson Township, Beaver County, Pa.

[73] Assignee: Westinghouse Electric Corp., Pittsburgh, Pa.

[21] Appl. No.: 112,665

[22] Filed: Jan. 16, 1980

[51] Int. Cl.[3] ..... H01H 75/10; H01H 77/06; H01H 81/04

[52] U.S. Cl. ..... 335/42; 335/176

[58] Field of Search ..... 335/42, 176, 45, 173, 335/174, 172, 170

[56] References Cited

U.S. PATENT DOCUMENTS

| | | | |
|---|---|---|---|
| 3,797,007 | 3/1974 | Salvati et al. | 335/176 |
| 3,806,847 | 4/1974 | Salvati | 335/176 |
| 3,845,432 | 10/1974 | Heberlein, Jr. et al. | 335/42 |
| 4,074,218 | 2/1978 | Salvati et al. | 335/176 |

*Primary Examiner*—Harold Broome
*Attorney, Agent, or Firm*—L. P. Johns

[57] ABSTRACT

A circuit interrupter trip unit characterized by a magnetic sensing and tripping device having improved means for adjusting between maximum and minimum air gaps between a magnet and armature for specific trip currents.

9 Claims, 5 Drawing Figures

CIRCUIT INTERRUPTER TRIP UNIT

BACKGROUND OF THE INVENTION

1. Field of the Invention

This invention relates to a protective device for a circuit interrupter and more particularly it pertains to a greater range of trip currents from minimum to maximum air gaps between the magnet and armature of a magnetic sensing device.

2. Description of the Prior Art

The device of this invention concerns circuit interrupters having trip units such as disclosed in U.S. Pat. Nos. 3,530,414; 3,797,007; 3,808,847; 3,815,064; 3,950,716; 3,950,717; and 4,074,218. Circuit breakers of that type have functioned satisfactorily for responding to such abnormal currents as overcurrents, ground fault currents, and short circuits that occur in an electrical distribution system. Notwithstanding the success of such circuit breakers for the purposes intended, there is a need for circuit breakers having a greater range for adjusting for specific trip currents between maximum and minimum air gaps between the magnet and armature of the trip device.

SUMMARY OF THE INVENTION

In accordance with this invention, a circuit interrupter is provided that comprises a trip device for responding to abnormal currents in the conductors of an electrical distribution system and for actuating a circuit interrupt to open upon the occurrence of predetermined operating conditions, comprising a circuit breaker having a first insulating housing, a breaker mechanism within the housing and including separable contacts adapted to be connected as part of an electrical distribution system, the circuit breaker mechanism having a releasable member movable from a latched position to effect opening of the contacts, a latch lever movable between latched and unlatched positions of the releasable member and being biased in the latched position, a trip unit including a stationary magnetic structure for each conductor of the distribution system and including a coil and core assembly and an armature, the unit including a trip bar movable to unlatch the latch lever and being biased in the latched position, the unit also including lever means associated with each stationary magnetic structure for moving the trip bar to the unlatched position, the lever means including the armature and being movable in response to abnormal currents in at least one of the conductors, the lever means including a lever on which the armature is mounted at a location spaced from a pivot line of the lever, the magnet and the armature having abutting surface areas that are disposed in planes that are generally parallel to a plane passing through the pivot line of the lever to reflect constant spacing during closing between said areas, calibrating means for adjusting the spacing between the magnet and the armature operatively connected to the lever and comprising an adjusting cam and a calibrating screw, a second insulating housing within the first insulating housing and enclosing the trip unit, and the second insulating housing including a body portion and a detachable cover adjacent to and providing access to the calibrating screw.

The advantage of the device of this invention is that it provides for an improved means for magnetically sensing and tripping a circuit breaker which is accomplished by a greater range of trip current from the minimum to the maximum air gaps and also a better means of adjusting for specific trip currents.

DESCRIPTION OF THE PREFERRED EMBODIMENT

Figure 1:
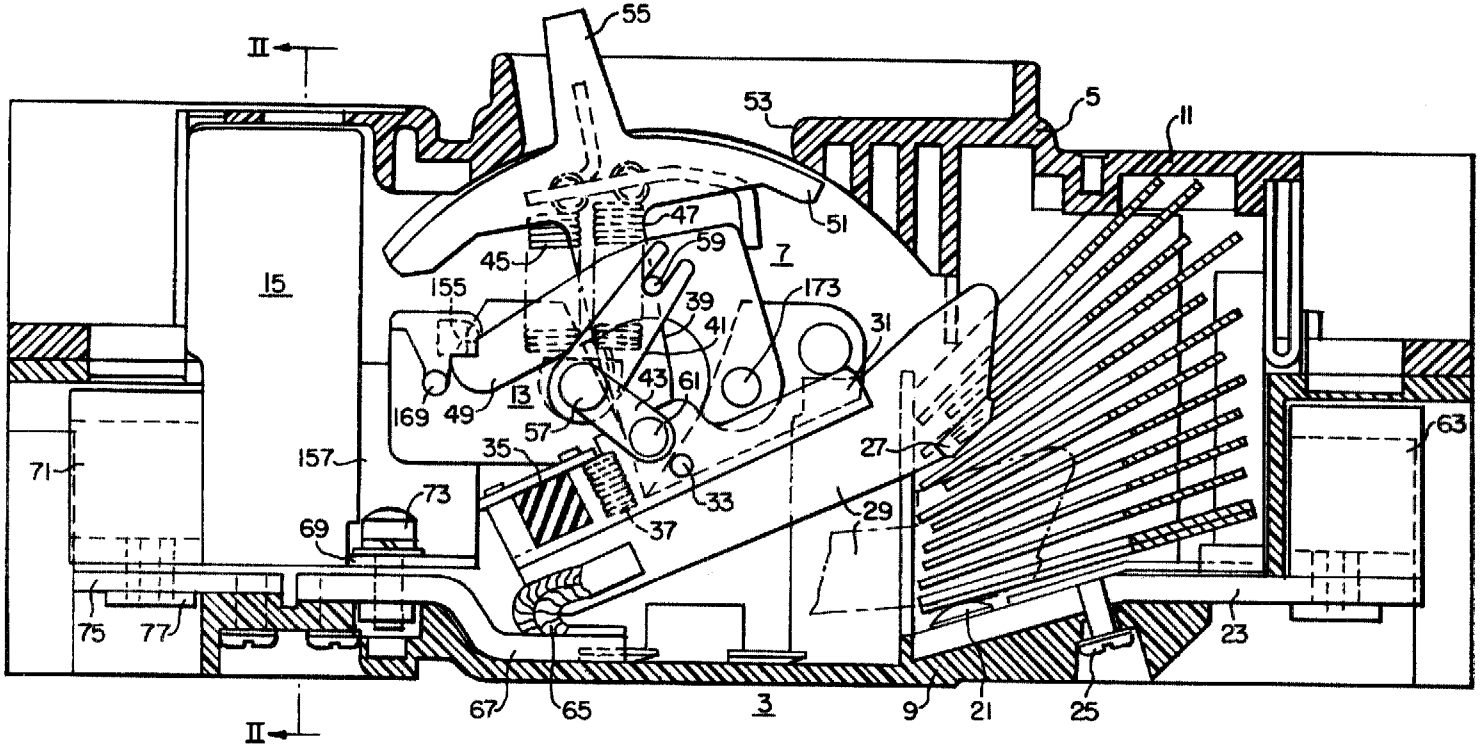
FIG. 1 is a vertical sectional view of a multi-pole circuit breaker.

In FIG. 1, a circuit breaker is generally indicated at 3 and it comprises an insulating housing 5 and a circuit breaker mechanism 7 supported within the housing. The housing 5 comprises an insulating base 9 and an insulating cover 11.

The circuit breaker mechanism 7 comprises an operating mechanism 13, and a latch and trip device 15. Except for the latch and trip device, the circuit breaker 3 is of the type that is generally described in the patent to Albert R. Cellerini et al, U.S. Pat. No. 3,287,534, issued Nov. 22, 1966. The circuit breaker 3 is a three-pole circuit breaker comprising three compartments disposed in side-by-side relationship. The center pole compartment (FIG. 1) is separated from the two outer pole compartments by insulating barrier walls formed with the housing base 9 and cover 11. The operating mechanism 13 is disposed in the center pole compartment and is a single operating mechanism for operating the contacts of all three pole units.

Each pole unit comprises a stationary contact 21 that is fixedly secured to a rigid main conductor 23 that in turn is secured to the base 9 by bolt 25. In each pole unit, a movable contact 27 is welded or brazed to a contact arm 29 that is mounted on a switch arm 31 by a pivot pin 33. The arms 29 and 31 for all three of the pole units are supported at one end thereof and rigidly connected to a common insulating tie bar 35 by which the arms of all three pole units move in unison. Each of the contact arms 29 is biased about the associated pivot pin 33 by means of a spring 37 to provide contact pressure in the closed position.

The operating mechanism 13 actuates the switch arms 31 between open and closed positions. The mechanism comprises a pivoted formed operating lever 39, a toggle comprising two toggle links 41 and 43, overcenter springs 45 and 47, and a pivoted releasable cradle or arm 49 controlled by the trip device 15. An insulating shield 51 for substantially closing an opening 53 in the cover 11, is mounted on the outer end of the operating lever 39 and has an integral handle portion 55 extending out through the opening to enable manual operation of the breaker. The toggle links 41 and 43 are pivotally connected together by a knee pivot pin 57. The toggle link 41 is pivotally connected to the releasable arm 49 by a pin 59, and the toggle link 43 is pivotally connected to the switch arm 31 of the center pole unit by a pin 61. The overcenter springs 45 and 47 are connected under tension between the knee pivot pin 57 and the outer end of the operating lever 39. The circuit breaker is manually operated to the open position by movement of the handle portion 55 in a counterclockwise direction to the "off" position, which movement actuates the overcenter springs 45, 47 to collapse the toggle links 41 and 43 to the position shown in FIG. 1, and opening movement of the contact arm 29 for all of the pole units in a manner well known in the art.

The circuit breaker is manually closed by reverse movement of the handle portion 55 from the "off" position to the "on" position, which movement causes the springs 45, 47 to move overcenter and straighten the toggle links 41, 43 thereby moving the contact arm 29, for all of the pole units, to the closed position as shown in broken line position.

The trip device 15 serves to effect automatic release of the releasable cradle or arm 49 and opening of the breaker contacts for all of the pole units, in response to predetermined overload conditions in the circuit breaker through any and all pole units of the circuit breaker in a manner described hereinbelow.

The circuit through each pole unit extends from a right-hand terminal 63 through the conductor 23, the contacts 21, 27, the contact arm 29, a flexible conductor 65, a conductor 67, a trip conductor 69, to a left-hand terminal connector 71. Bolt means 73 secure one end of the trip conductor 69 to the conductor 67 and the other end of the trip conductor 69 is disposed between a backup plate 75 and the terminal 71 where it is secured in place by mounting bolt 77 of the terminal 71.

Figure 5:
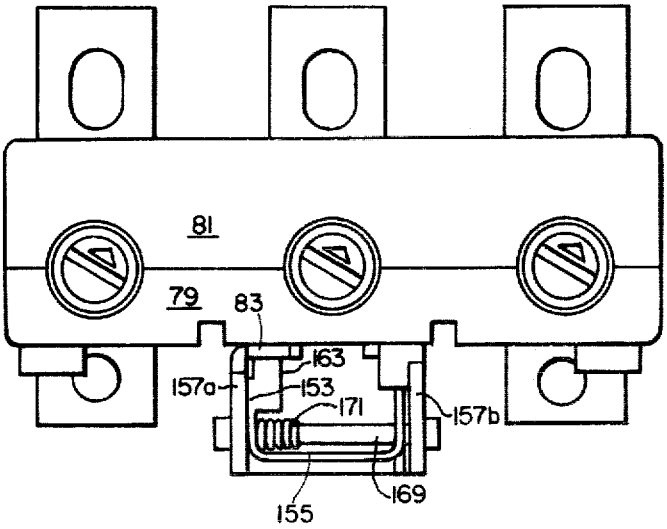
FIG. 5 is a plan view of the trip device shown in FIGS. 1–4.

The latch and trip device 15 (FIGS. 2–5) comprises a molded insulating housing base 79 and a molded insulating housing cover 81 secured to the base to enclose a molded insulating trip bar 83 that is common to all three of the pole units. The base 79 (FIG. 2) includes a pair of spaced partitions 85 and 87 which are vertically disposed and integral with the base for separating the interior of the housing into three compartments, each compartment containing one of the three poles. In a similar manner, the cover 79 is provided with partitions corresponding to partitions 85 and 87 and have mating surfaces therewith in a manner similar to the mating surfaces of the peripheral surfaces of the base 81 and cover 79 as indicated by a parting line 89 (FIG. 5).

The partitions 85 and 87 (FIG. 2) have notches 91 and 93, respectively, which together with flat surfaces of the cover 79 serve as journals for round shaft portions 95 and 97 of the trip bar 83. When the housing base 81 and cover 79 are assembled, they retain the trip bar 83 in place whereby the trip bar is free to rotate on an axis extending through the shaft portions 95 and 97. Each section of the trip bar 83 (FIG. 3) located within the space compartments of the housing comprise upper and lower portions **83*a* and 83*b*, which are above and below an axis of rotation of the trip bar. Each upper portion 83*a* includes an adjusting screw and nut assembly 99 which cooperates with a bimetal member 101 for adjusting the spacing between the upper ends of the bimetal member and the trip bar position 83*a* in response to the degree of deflection of the upper end of the member 101 toward the bar 83, whereby the trip bar 83 is rotated counterclockwise by the bimetal member and thereby trips the circuit breaker to the open position. The lower end portion 83*b*** is contacted for rotation of the trip bar in the manner to be described hereinbelow.

The latch and trip device 15 also comprises lever means including a lever 105 (FIGS. 2, 3) for each pole. Each lever (FIG. 2) includes a pair of oppositely disposed pivot notches 107 which are pivoted about corresponding opposite pivot tabs 109 which are integral parts of the housing base 79. Each lever 105 (FIG. 3) includes an upper portion on which an adjusting screw 111 is mounted and a lower portion on which an armature 113 is mounted in a suitable manner such as by spot welds 115.

Moreover, in accordance with this invention, the latch and trip device 15 comprises a magnetic structure including an inverted U-shaped portion 117 which portion becomes a heater when subjected to a current overload of the conductor 69. The magnetic structure also comprises a magnetic core or magnet 119 which is a channel member fixedly mounted on one leg of the portion 117. The magnet 119 cooperates with the armature 113 for magnetically sensing and tripping the circuit breaker.

Figure 2:
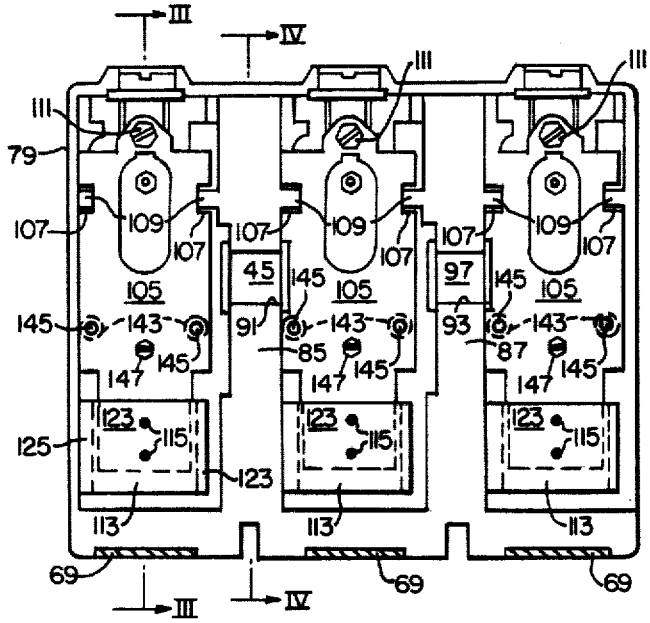
FIG. 2 is a vertical sectional view taken on the line II—II of FIG. 1.
Figure 3:
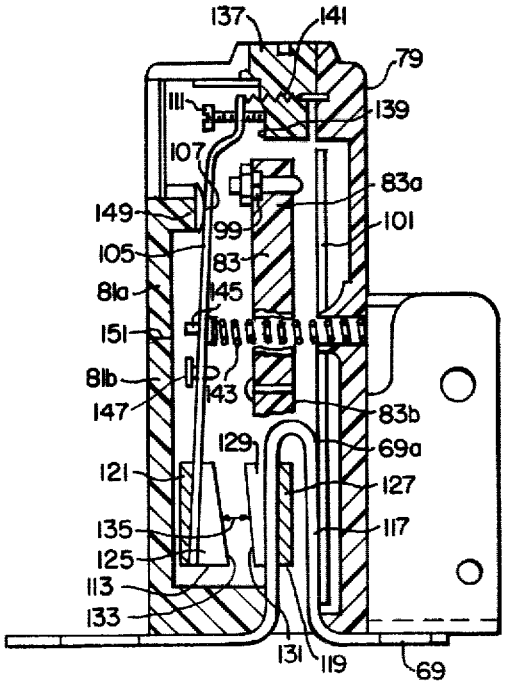
FIG. 3 is a vertical sectional view taken on the line III—III of FIG. 2.
Figure 4:
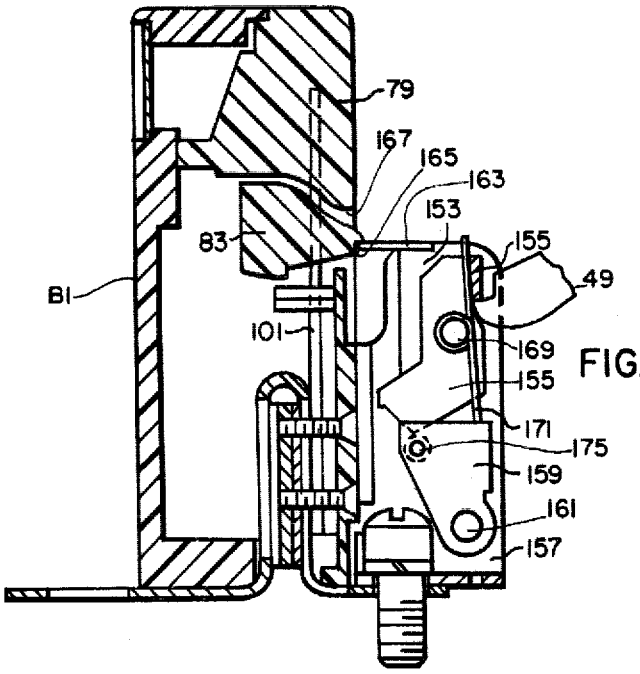
FIG. 4 is a vertical sectional view taken on the line IV—IV of FIG. 2.

The armature 113 and the magnet 119 are channel members, the armature 113 having an intermediate portion 121 and spaced legs 123, 125 (FIG. 2). Similarly, the magnet 119 includes an intermediate portion 127 with spaced legs of which one leg 129 is shown (FIG. 3), which magnet legs correspond and are in surface to surface contact with the legs 123, 125 of the armature 113, when the lever 105 is rotated clockwise during a tripping operation. Mating surfaces of the aligned spaced legs of the magnet and armature such as the surfaces 131, 133 of the magnet 119, and armature 113 respectively, are separated by a space or air gap 135.

In accordance with this invention, the surfaces 131, 133 for each pair of legs of the magnet and armature are parallel, or substantially perpendicular to the magnetic flux lines extending between the magnet and armature. The surfaces 113, 133 are also preferably inclined to a transverse cross-section through the magnet or armature, or to the intermediate portions 119, 121. The angle of inclination is an acute angle extending from the ends of the magnet and armature remote from the pivot or notches 107 of the lever 105 to the ends of the magnet and armature nearer the pivot. In the alternative the surfaces 131, 133 may be either at an angle or parallel to the intermediate portions 121, 127, and are substantially parallel to each other when open to provide a greater range of trip current from a minimum to a maximum air gap and also to provide better means of adjusting for specific trip currents.

Additionally, means are provided for adjusting the spacing 135, whereby upon maximum spacing of the armature from the magnet, a greater current overload is required to attract the armature to the magnet. Conversely, when the spacing is reduced, a smaller overload current is required to actuate the trip bar 83. For that purpose, calibration means including the adjusting screw 111 is secured at the upper end of the lever 105. An adjusting knob 137 is seated within the top end of the housing base 79 and is provided with a lower end portion having a cam surface 139. The lever 105 is biased clockwise about its pivot point by a tension spring 141 extending between the upper end of the lever and the housing base 79 for holding the end of the adjusting screw 111 against the cam surface 139. Turning the adjusting knob 137 moves the armature 113 through numerous working settings of the air gap 135 from a minimum of 3/32 inch gap to a maximum of ¼ inch gap. In addition, rotation of the adjusting screw 111 provides a vernier air gap adjustment for providing closer calibration tolerances.

Armature floating spring means such as a pair of similar springs 143 for each lever 105 which brings together with a spring load adjusting screw 145 are employed to further adjust the desired forces acting on the armature. The adjusting screws 145 increase or decrease the forces of the springs acting on the armature, thus insuring additional adjustment to obtain the desired trip-current values.

A tripping screw 147 is also mounted on the lever 105 to cooperate with the trip bar to ensure proper action of the trip bar when the circuit breaker is tripped. When an overload current above a value such, for example, as ten times the normal rated current or a short circuit occurs, the stationary magnetic structure is energized and the armature 113 is attracted towards the magnet 119 causing instantaneous release of the release arm 49 and opening of the contacts 21, 27.

The latch and trip device 15 also includes additional means for tripping the circuit breaker, which means includes the bimetal member 101, the lower of which is secured in place by suitable means in surface-to-surface contact with the U-shaped portion 117, whereby upon the occurrence of a low persistent overload current below a predetermined value of, for example, ten times normal rated current, the bimetal member 101 is heated and deflects to the right through an air gap dependent upon the setting of the adjustment screw 99. Thus, when a low persistent overload current occurs, the trip bar 83 is actuated to trip the circuit breaker.

Since the housing cover 81 is used to hold the lever 105 in place on its pivot point, it is necessary to assemble the trip unit completely before calibrating the position of the lever. For that reason, the cover 81 is comprised of two portions including an upper portion 81*a* which includes an inturned projection 149 for holding the lever 105 in place on the pivot tabs 109. A parting surface 151 is disposed between the upper cover 81*a* and the lower cover 81*b*. After the upper cover 81*a* is secured in place, final calibration of the latch and trip unit 15 is accomplished by the spring load adjusting screws 145 and the lower cover 81*b* is mounted in place.

The mechanism by which releasable arm 49 (FIGS. 1, 4, 5) is released, includes the trip bar 83, the trip lever 153, and a latch lever 155. A U-shaped mounting frame 157 is mounted on the base 79 with spaced upright sides 157*a* and 157*b* (FIG. 5) providing mounting support for the levers. The trip lever 153 includes a U-shaped portion 159 at the lower end, which portion is mounted on a pivot pin 161 which extends between the upright sides 157*a* and 157*b*. The U-shaped portion 159 of the lever maintains the lever upright adjacent to the frame side 157*a*. The upper end of the trip lever 153 includes a flange 163 which engages a notch 165 on the trip bar 83. A portion of the trip bar 83 (FIG. 4) extends through an opening 167 in the insulating base 79.

The latch lever 155 includes down-turned portions which are mounted on a pivot pin 169, the opposite ends of which are secured in the opposite sides 157*a*, 157*b*. A spring 171 is mounted on the pin 169 and has end portions engaging the levers 153 and 155 for biasing the levers in the latched positions.

When the releasable arm 49 is in the latched position (FIG. 1), the arm which is pivoted on a pivot pin 173 is secured in the latched position below the lever 155 and applies a rotatable force thereon. The latch lever 155 is prevented from turning due to engagement of the lower end of the lever on a pin 175 which is mounted in the U-shaped portion 159 of the trip lever 153. As a result of the rotating force on the latch lever 155, the trip lever 153 is biased clockwise and is prevented from movement by engagement of the flange 163 in the notch 165 of the trip bar 83. When the trip bar is rotated counterclockwise, the flange 163 is dislodged from the latch position within the notch 165 and the trip lever 153 rotates clockwise to move the pin 175 from engagement with the lower end of the latched lever 155. As a result the latch lever 155 is free to rotate counterclockwise about the pin 169 and thereby unlatch the releasable arm 49 from the from the latched position.

In conclusion, the device of the present invention provides a new and novel trip device for a circuit breaker which comprises a unitized assembly of a lever and armature, the latter of which has mating faces with parallel surfaces on a magnet to facilitate adjusting for specific trip currents. Associated with the foregoing is the provision of a two-piece housing cover to enable sequential assembly in calibration in the final assembly procedure.

What is claimed is:

1. A circuit interrupter for responding to abnormal currents in the conductors of an electrical distribution system, comprising: a first insulating housing, a breaker mechanism within the housing, separable contacts adapted to be connected as part of an electrical distribution system, the breaker mechanism having a releasable member movable to an unlatched position from a latched position to effect opening of the contacts, a latch lever movable between the latched and unlatched positions of the releasable member, a trip unit including a stationary magnetic core for each conductor of the distribution system and including a coil which interacts with said magnetic core and an armature which interacts with said magnetic core, the trip unit including a trip bar movable to unlatch the latch lever and being biased in a latched position, the trip unit also including lever means associated with each stationary magnetic structure for moving the trip bar to an unlatched position, the lever means including the armature and being movable in response to abnormal currents in at least one of the conductors, the lever means including a lever on which the armature is mounted at a location spaced from the lever pivot, the magnetic core and the armature having abutting surface areas that are disposed in planes that are generally parallel when separated, whereby constant spacing during closing between said areas is maintained.

2. The device of claim 1 in which the planes are perpendicular to magnetic flux lines extending between the magnetic core and armature.

3. The device of claim 1 in which the planes of the surface areas are inclined to the transverse cross-section through the magnetic core and armature.

4. The device of claim 2 in which the angle of inclination is an acute angle extending from the ends of the magnetic core and armature remote from the pivot of the lever to the ends thereof nearer said point.

5. The device of claim 1 in which calibration means are provided for adjusting the spacing between the magnetic core and the armature operatively connected to the lever.

6. The device of claim 5 in which the calibration means includes a calibration screw on the lever and an adjusting cam operatively connected to the calibrating screw.

7. The device of claim 6 in which the calibrating means is disposed at the end of the lever opposite the armature.

8. The device of claim 7 in which a second insulating housing is contained within the first insulating housing and encloses the trip unit.

9. The device of claim 8 in which the second insulating housing includes a body portion and a detachable cover adjacent to and providing access to the calibrating screw.

* * * * *